US010240266B2

(12) United States Patent
Lonati et al.

(10) Patent No.: US 10,240,266 B2
(45) Date of Patent: Mar. 26, 2019

(54) CIRCULAR KNITTING MACHINE WITH AN ENGAGING AND DISENGAGING MECHANISM OF THE HOOK PLATE OF THE DIAL GROUP

(71) Applicant: SANTONI S.P.A., Brescia (IT)

(72) Inventors: Tiberio Lonati, Brescia (IT); Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 394 days.

(21) Appl. No.: 15/028,339

(22) PCT Filed: Sep. 30, 2014

(86) PCT No.: PCT/IB2014/064956

§ 371 (c)(1),
(2) Date: Apr. 8, 2016

(87) PCT Pub. No.: WO2015/059592

PCT Pub. Date: Apr. 30, 2015

(65) Prior Publication Data

US 2016/0258087 A1 Sep. 8, 2016

(30) Foreign Application Priority Data

Oct. 24, 2013 (IT) ..... BS2013A0150

(51) Int. Cl.

| | |
|---|---|
| ***D04B 9/00*** | (2006.01) |
| ***D04B 9/06*** | (2006.01) |
| ***D04B 15/94*** | (2006.01) |

(52) U.S. Cl.
CPC ..... *D04B 9/06* (2013.01); *D04B 15/94* (2013.01)

(58) Field of Classification Search
CPC ..... D04B 9/06; D04B 15/94
(Continued)

(56) References Cited

U.S. PATENT DOCUMENTS 3,974,663 A 8/1976 Vinci et al.
4,339,932 A 7/1982 Lonati
(Continued)

FOREIGN PATENT DOCUMENTS

EP 1686206 A1 8/2006

*Primary Examiner* — Katharine Gracz
(74) *Attorney, Agent, or Firm* — Pearne & Gordon LLP

(57) ABSTRACT

A circular knitting machine (1) for knitwear or hosiery, comprising a bearing structure, needle cylinder (C), a plurality of needles, and a dial group. The dial group comprises a support ring (4), a hook plate (5), and a thread feeding and cutting organ. The knitting machine comprises rotation transmission means (10) comprising: a drive pulley (11), a hook plate shaft (12), a flange (13) and an engaging mechanism (20) which operates between an engaged configuration, in which it constrains the pulley and the flange to one another, and a disengaged configuration, in which the flange is free from constraints. The engaging mechanism comprises an engaging organ (21) and actuating means (30) which enable the passage from the engaged configuration to the disengaged configuration in any angular position assumed by the flange or the pulley, and the passage from the disengaged configuration to the engaged configuration with the engaging organ positioned at a predetermined number of angular engaging and disengaging positions (40).

20 Claims, 7 Drawing Sheets

(58) Field of Classification Search
USPC ..... 66/56
See application file for complete search history.

(56) References Cited

U.S. PATENT DOCUMENTS

| | | | | | |
|---|---|---|---|---|---|
| 4,346,571 | A | * | 8/1982 | Micheletti | D04B 15/94 66/237 |
| 4,580,418 | A | * | 4/1986 | Yang | D04B 15/94 66/147 |
| 4,608,839 | A | * | 9/1986 | Tibbals, Jr. | D04B 9/12 66/13 |
| 4,711,100 | A | * | 12/1987 | Tibbals, Jr. | D04B 9/12 66/104 |
| 2006/0169002 | A1 | | 8/2006 | Lonati et al. | |

* cited by examiner

CIRCULAR KNITTING MACHINE WITH AN ENGAGING AND DISENGAGING MECHANISM OF THE HOOK PLATE OF THE DIAL GROUP

The present invention relates to a circular knitting machine. In particular, the invention relates to a circular knitting machine characterised by an engaging and disengaging mechanism of the rotation of the hook plate of the dial group with respect to the rotation of the needle cylinder.

The present invention relates to the technical sector of circular knitting machines, seamless type machines, hosiery machines and the like.

In the present description, the term "knitting machine" is meant in general to relate to a circular knitting machine for production of textile articles and provided with a plurality of thread feeding points, in which the thread is supplied to the needles of the machine. The knitting machine can be for example of a single-bed or a double-bed type. Circular knitting machines can comprise a variable number of thread feeders, for example 2, 4, 6, 8 or more.

In the present description the expression "dial group" is intended to mean a portion of the knitting machine arranged superiorly of the needle-bearing organ and provided with organs and devices able to cooperate with the needles of the knitting machine and with the threads present in the thread feeders so as to enable production of fabric.

In the sector of circular knitting machines, various types of realization of the dial group are known, together with the devices connected thereto. In general, the dial group is typically provided with a fixed support plate (or ring), mounted to the bearing structure of the knitting machine, a transport and cutting organ of the threads (known in the sector as a cutter) mounted externally of the support ring so as to be able to rotate about it, and a plurality of pneumatic devices positioned on the support plate.

The plurality of pneumatic devices usually comprises at least a hook control group provided with one or more command cams, able to interact with the hooks of the knitting machine, and a plurality of pliers groups, equal in number to the feeders of the machine; each pliers group comprises one or more mobile pliers, able to retain or block a thread supplied to the needles of the knitting machine, and the pneumatic actuators moving the pliers.

The dial group can further comprise cutting devices, each provided with a pneumatically-activated cutting organ able to cooperate with the cutter so as to carry out the cut of the threads transported by the cutter. In addition, the dial group can comprise thread-aspirating devices which aspirate the threads of one or more feeders and the relative fluff.

In substance, the dial group comprises internally thereof a grouping of numerous devices, some modularly repeated for each thread feeder, others shared among a plurality of feeders, or present singly.

The dial group further comprises a hook support organ, or "hook plate", bearing a plurality of hooks. The hook plate is mounted to the support plate so as to be able to rotate about a rotation axis coinciding with the rotation axis of the needle cylinder. The cutter is further solidly constrained to the hook plate, and rotates together therewith.

Known knitting machines further comprise transmission means which carry out the function of transmitting to the hook plate the rotation generated for the needle cylinder. In fact, if the hook plate were activated independently with respect to the needle cylinder, the motion thereof might "lag" with respect to the cylinder, while it is necessary, in order to correctly knit fabric, for the hook plate and cylinder to move when knitting with a synchronous rotation. Therefore the transmission means typically comprise pairs of pulleys, transmission belts and auxiliary shafts that transmit—synchronously—to the hook plate the rotation generated by a motor moving the needle cylinder.

Although when knitting they include the synchronous and constant rotation of the needle cylinder and the hook plate the known knitting machines require the dial group to be raisable with respect to the needle cylinder in order for maintenance operations to be carried out. These operations can comprise, for example, verification of the stitches formed and under formation on the needle cylinder, the manual detachment of the stitching produced by the needles, the replacement of broken needles or other broken components, etc. During the raising, the dial group draws the threads held by the underlying thread guide feeders of the knitting machine: therefore the threads remain interposed and suspended between the cylinder and the dial group in the vertical space which is created by raising the dial group. In the maintenance configuration (typically activated by the operator via a manual command), the whole dial group (comprising hook plate and cutter) is raised and does not need to be in rotation, while the underlying needle cylinder must be able to be rotated in order to carry out the above-mentioned operations. However, as the drive transmission is located between the needle cylinder and the hook plate, the hook plate too (though the dial group is raised) continues to rotate synchronously with the underlying cylinder.

This leads to some significant drawbacks, as:

- in the maintenance configuration, the cutter also continues to rotate, together with the hook plate, synchronously with the cylinder; this means that the operator, during the maintenance activity being carried out on the needle cylinder, works with the dial group raised and with the cutter in rotation, with evident safety issues related to the presence of the cutter in motion and, what is more, provided with cutting teeth;
- the fact that to a rotation of the cylinder, during maintenance, corresponds a rotation of the hook plate, causes the cutting—by the cutter—of the threads held by the thread guides and pulled upwards by the raising of the dial group.

To mitigate the problem of safety given by the continuously-rotating cutter, the maintenance configuration included, in some known machines, the limitation to a slow velocity (slow mode) of the needle cylinder, with rotation activated by hand by the operator, for example with a crank.

Concerning, on the other hand, the problem of undesired cutting of the threads, in some known machines the operator first cuts the suspended threads, positioning them internally of the cylinder, preventing the cut by the rotating cutter also in the maintenance configuration.

To obviate the above-cited problems, machines are known which exhibit disengaging mechanisms of the cutter which enable, when the dial group is brought into the raised position in order to carry out maintenance, interrupting or disengaging the transmission of drive from the needle cylinder to the cutter (or the hook plate bearing the cutter): in this way the needle cylinder can continue to rotate, while the cutter remains stationary.

However, these solutions too present important drawbacks: in fact, when the transmission from the cylinder to the cutter (or hook plate) is interrupted, the reciprocal positioning among the elements is removed. In other words, the fact that the cutter is "released" when the hook plate is raised, means, on the subsequent descent thereof to recommence with the normal production of the knitting machine, the hook plate (and the cutter solidly constrained thereto) are no long angularly orientated correctly with respect to the cylinder, i.e. they no longer exhibit the same angular position they exhibited before the disengagement and the release from the transmission.

In fact, the rotation of the needle cylinder during maintenance (with the cutter stationary) introduces an angular lag that is not predictable: if the dial group were returned into the lowered position without resetting the synchrony between the cylinder and the cutter, the machine would not be able to operate correctly and the knitting production would be compromised.

To obviate this drawback, some known machines enable raising, and then lowering, the dial group only in determined angular positions. In substance, the operator brings the cylinder into a determined angular position in which the "release" of the hook plate is enabled, raises the dial group, performs the maintenance (freely rotating the needle cylinder without the hook plate rotating) and then returns—necessarily—the cylinder exactly into the same angular position in which the dial group had been raised, then to proceed with the lowering thereof and then carrying on with the knitting. This solution enables being sure, when the dial group is lowered, that the dial group is synchronised with the needle cylinder. However, this solution also presents some drawbacks:

- it is necessary to wait for an angular position which enables raising the dial group and thus the disengaging of the cutter;
- it is necessary, on finishing the maintenance, to wait for portion of a revolution before returning the dial group into the lowered position;
- it is not possible to rise and fall into position as desired, but only in a limited number of positions;
- the raising and descent of the dial group require additional rotations only so as to guarantee the maintaining of the synchronising between cylinder and hook plate;
- the descent into a wrong position compromises the knitting functionality of the knitting machine;

therefore the known solutions require control systems so as to prevent errors occurring in the reciprocal positioning between the cylinder and the hook plate.

Also known are knitting machines equipped with engaging and disengaging mechanisms of the dial group with respect to the needle cylinder. However the applicant has found that these solutions too are not free of drawbacks and are improvable in various ways. In particular, these known solutions exhibit the drawbacks of being structurally complex and/or subject to wear or breakage and/or difficult to manage by the operator and/or expensive and/or difficult to implement on a knitting machine.

In this situation the aim underpinning the present invention, in its various aspects and/or embodiments, is to disclose a circular knitting machine that is able to obviate one or more of the mentioned drawbacks.

A further aim of the present invention is to provide a knitting machine characterised by an effective engaging and disengaging system of the dial group (i.e. the rotation of the hook plate and the cutter) with respect to the rotation of the needle cylinder.

A further aim of the present invention is to provide a knitting machine enabling carrying-out maintenance operations simply and/or rapidly.

A further aim of the present invention is to provide a knitting machine able to guarantee a correct synchronising between the needle cylinder and the dial group (in particular the hook plate and the cutter) in any operating condition, and in particular following a maintenance operation performed on the needle cylinder.

A further aim of the present invention is to provide a knitting machine characterised by a high functioning reliability and/or by a low predisposition to faults and malfunctioning.

A further aim of the present invention is to provide a knitting machine characterised by a simple and rational structure, in particular as concerns the engaging and disengaging system of the dial group.

A further aim of the present invention is to provide a knitting machine characterised by a realisation cost that is modest with respect to the performance and quality it provides.

These aims, and possibly others too, which will more fully emerge during the course of the following description, are substantially attained by a circular knitting machine according to one or more of the accompanying claims, each of which taken alone (without the relative dependencies) or in any combination with the other claims, as well as according to the following aspects and/or embodiment, variously combined, also with the above-mentioned claims.

In a first aspect the invention relates to a circular knitting machine for knitwear or hosiery, comprising:

- a bearing structure;
- at least a needle-bearing organ or needle cylinder rotatably mounted in the bearing structure and rotatable selectively, by means of rotation means of the cylinder about a rotation axis of the needle cylinder;
- a plurality of needles supported by the needle cylinder and mobile parallel to a rotation axis of the needle cylinder so as to produce a knitted fabric;
- a dial group arranged above the needle cylinder and comprising:
- a support plate (or ring) solidly constrained to the bearing structure and coaxial to the needle cylinder;
- a hook support organ, or hook plate, bearing a plurality of hooks, the hook plate being rotatably mounted to the support plate in such a way as to rotate about a respective rotation axis coinciding with the rotation axis of the needle cylinder;
- a plurality of devices of the dial group, arranged on the support plate;
- a thread transport and cutting organ, or cutter, mounted externally of the support plate and solidly constrained to the hook plate, in such a way as to rotate together with the hook plate.

In a further aspect the knitting machine comprises rotation transmission means, housed in the bearing structure and operatively interposed between the needle cylinder and the dial group, configured for transmitting a rotation, generated by said rotation means of the cylinder, synchronously with the hook plate, such that a determined rotation of the hook plate corresponds to a same rotation of the needle cylinder.

In an aspect, the rotation transmission means comprise:

- a drive pulley receiving a rotary motion from the rotation means of the cylinder and rotating, synchronously with respect to the needle cylinder about a first rotation axis;
- a hook plate shaft, coaxially mounted to the hook plate and configured for transmitting a rotation to the hook plate;
- a flange, configured for transmitting a rotary motion to the shaft of the hook plate, operatively interposed between the pulley and the hook plate shaft and positioned at the pulley, the flange being able to rotate about the first rotation axis (A);

an engaging mechanism operatively interposed between the pulley and the flange and configured for selectively operating at least between an engaged configuration, in which it constrains the pulley and the flange to one another, determining a synchronous transmission of the rotary drive of the pulley to the flange and from the flange to the hook plate shaft, and a disengaged configuration, in which the flange is free from constraints with respect to the pulley and the rotary motion of the pulley is not transmitted to the flange.

In an aspect the engaging mechanism comprises at least an engaging organ movable, between the pulley and the flange, in a direction which is parallel to, or transversally or perpendicularly intersecting, the first rotation axis of the pulley and the flange, between at least an engaged position and a disengaged position so as to determine passage of the engaged mechanism respectively between the engaged position and the disengaged position.

In an aspect the engaging mechanism comprises actuating means operatively active on the engaging organ and configured for enabling the passage of the engaging mechanism from the engaged configuration to the disengaged configuration in any angular position assumed by the flange or the pulley, and for determining the passage of the engaging mechanism from the disengaged configuration to the engaged configuration exclusively with the engaging organ positioned at a predetermined and limited number of angular engaging and disengaging positions defined on the flange or the pulley.

In an aspect, on the flange or the pulley, a number of angular engaging and disengaging positions are defined which are fewer than four or four and/or fewer than two or two and/or wherein, preferably, on the flange or pulley, one and one only angular engaging and disengaging position is defined.

In an aspect the engaging organ is mobile, between the pulley and the flange, in a substantially radial direction with respect to the first rotation axis, i.e. substantially perpendicular to, and intersecting the, first rotation axis of the pulley and the flange. In an aspect the engaging organ is movable on a substantially horizontal plane.

In an aspect the pulley rotates about a rotation axis coinciding with the rotation axis of the needle cylinder. In an aspect, the shaft of the hook plate extends from an upper end to a lower end, the hook plate being mounted to the lower end of the shaft of the hook plate.

In an aspect, the flange is mounted coaxially to the upper end of the hook plate shaft. In an aspect the first rotation axis coincides with the rotation axis of the needle cylinder and the hook plate.

In an aspect the knitting machine comprises raising means of the dial group, configured for vertically translating the whole dial group with respect to the needle cylinder along the rotation axis of the needle cylinder, so as to position the hook plate at least between a lower (or lowered) position, in which it is neared to the needle plate, and an upper (or raised) position, in which it is vertically distanced from the needle cylinder with respect to the lower position, the raising means comprising an actuator active on the flange and/or on the shaft of the hook plate.

In an aspect a passage of the hook plate, by the raising means of the dial group, from the lower position to the upper position, automatically determines, for each angular position assumed by the pulley and the flange rotating solidly, the passage of the engaging mechanism into the disengaged position, deconstraining the flange with respect to the pulley, determining the halting of the hook plate and maintaining the pulley in rotation.

In an aspect a passage of the hook plate, by the raising means of the dial group, from the upper position to the lower position, and a relative rotation, without transmission of drive, between the pulley and the flange up to reaching, by the engaging organ, of the angular engaging and disengaging position, determine an automatic passage of the engaging mechanism into the engaged position, constraining the flange with respect to the pulley and determining the synchronous rotation of the hook plate with respect to the needle cylinder.

In an aspect the relative rotation between the pulley and the flange, without transmission of drive, during the passage of the engaging mechanism from the disengaged position to the engaged position, has an angular dimension defining a resynchronising angle, the resynchronising angle being strictly smaller than 360°.

In an aspect the resynchronising angle is equal to the corresponding angle of relative rotation between pulley and flange in order for the engaging organ to reposition at the angular engaging and disengaging position.

In an aspect the engaging mechanism comprises the engaging organ, positioned on the pulley or flange, and at least an engaging/disengaging seating defining the angular engaging and disengaging position and positioned, respectively, on the flange or on the pulley, the engaging/disengaging seating being configured for stably housing the engaging organ when in the engaged position, enabling a synchronous transmission of the drive between the pulley and the flange, and consequently between the needle cylinder and the hook plate.

In an aspect the engaging organ comprises a wheel rotatably mounted on a pin the wheel being free to rotate about the pin and being preferably orientated on a plane comprising the first rotation axis of the pulley and the flange, the pin being perpendicular to the wheel and being able to translate in a radial direction with respect to the first rotation axis, so as to near or distance the wheel with respect to the first rotation axis.

In an aspect the translation of the pin determines the positioning of the wheel at least between an advanced position, in which the wheel is radially neared to the first rotation axis and the engaging organ is brought into the engaged position, and a retracted position, in which the wheel is radially distanced from the first rotation axis and the engaging organ is in the disengaged position.

In an aspect the actuating means comprise at least an elastic organ active on the pin and/or on the wheel so as to exert thereon a thrust facing, in a radial direction, towards the first rotation axis, so as to maintain the wheel in an advanced position or to push the wheel towards the advanced position.

In an aspect the actuating means comprise a pair of elastic organs active on the pin at two opposite sides of the pin with respect to the wheel. In an aspect the elastic organ is a spring or a helix spring.

In an aspect the engaging organ is positioned on the pulley and the engaging/disengaging seating is positioned on the flange.

In an aspect the engaging organ is positioned externally of the flange, i.e. it is positioned at a radial distance from the first rotation axis greater than the respective radial distance of the engaging/disengaging seating from the first rotation axis.

In an aspect the engaging organ is positioned in such a way as to be at, and radially aligned with, the engaging/disengaging seating when it reaches, by effect of the rotation of the pulley, the angular engaging and disengaging position.

In an aspect the engaging/disengaging seating is configured for enabling automatic entry, via the actuating means, of the engaging organ internally thereof, when the hook plate is brought, by the raising means, into the lower position and the pulley has made a rotation equal to the resynchronizing angle.

In an aspect the flange exhibits an upper surface, a lower surface and a lateral surface of annular shape, extending between, and connecting, the upper surface and the lower surface, the engaging/disengaging seating being a radial recess starting from the lateral surface and externally open.

In an aspect the recess realizing the engaging/disengaging seating is open at least at a portion of the portion of the lower surface of the flange, so that the raising of the hook plate in the upper position determines the exit of the engaging organ from the engaging/disengaging seating and passage of the engaging mechanism into the disengaged position.

In an aspect the rotation transmission means comprise at least a braking organ operatively active on the hook plate and configured for exerting a braking force on the hook plate when the pulley rotates, without any drive transmission, with respect to the flange and the wheel translates laterally, draggingly, on the lateral surface of the flange.

In an aspect the braking organ exerts the braking force, following a lowering of the plate into the lower position, for at least a 360° rotation of the pulley or for at least a rotation of the pulley by an angle equal to the resynchronising angle, such as to enable the engaging organ to reach the engaging/disengaging seating.

In an aspect the rotation means of the needle cylinder are configured so as to set the needle cylinder and the drive pulley in rotation in a single rotation direction, the rotation preferably being continuous regardless of the configuration assumed by the engaging mechanism.

In an aspect the rotation transmission means comprise:

a lower belt, rotated by the rotation means of the cylinder;

a relay shaft, located laterally of the needle cylinder and inferiorly connected to the lower belt;

an upper belt, rotated by the relay shaft and configured for transmitting the rotary motion from the relay shaft to the pulley.

In an aspect the bearing structure comprises a sleeve arranged coaxially to the cylinder rotation axis and provided with a through-opening crossed by, and housing, the hook plate shaft and provided with a lower end to which the support plate is solidly mounted and from which the lower end of the shaft of the hook plate emerges inferiorly, to which lower end the hook plate is mounted, the sleeve structurally bearing the support plate and the devices present thereon and enabling, via the shaft of the hook plate able to rotate and translate internally thereof, the rotation and vertical translation of the hook plate and the cutter.

In a further independent aspect, the invention relates to a circular knitting machine for knitting or hosiery, comprising:

a bearing structure;

at least a needle-bearing organ or needle cylinder rotatably mounted in the bearing structure and rotatable selectively, by means of rotation means of the cylinder, about a rotation axis of the needle-bearing cylinder;

a plurality of needles supported by the needle cylinder and mobile parallel to a rotation axis so as to produce a knitted fabric;

a dial group arranged above the needle cylinder and comprising:

a support plate (or ring) solidly constrained to the bearing structure and coaxial to the needle cylinder;

a hook support organ, or hook plate, bearing a plurality of hooks, the hook plate being rotatably mounted to the support plate in such a way as to rotate about a respective rotation axis coinciding with the rotation axis of the needle cylinder;

a plurality of devices of the dial group, arranged on the support plate;

a thread transport and cutting organ, or cutter, mounted externally of the support plate and solidly constrained to the hook plate, in such a way as to rotate together with the hook plate, the knitting machine comprising rotation transmission means, housed in the bearing structure and operatively interposed between the needle cylinder and the dial group, configured for transmitting a rotation, generated by the rotation means of the cylinder, synchronously with the hook plate, such that a determined rotation of the hook plate corresponds to a same rotation of the needle cylinder, wherein the rotation transmission means comprise an engaging mechanism configured for selectively operating at least between an engaged position, in which it enables a synchronous transmission of the rotary motion from the rotation means of the cylinder to the hook plate, and a disengaged configuration, in which it interrupts the rotary drive transmission from the rotation means of the cylinder to the hook plate, the hook plate interrupting rotation thereof.

In an aspect the rotation transmission means comprise:

processing means;

a first sensor positioned on the bearing structure and configured for detecting a first angular reference position relative to the needle cylinder, during the rotation of the needle cylinder, and for transmitting to the first processing means a first detecting datum of the first reference angular position;

a second sensor positioned on the dial group and configured for detecting a second reference angular position relative to the hook plate, or directly correlated to the hook plate, during the rotation of the hook plate, and for transmitting to the processing means a second detecting datum of the second reference angular position;

wherein the processing means are configured and predisposed to compare the first detecting datum with the second detecting datum, with the aim of verifying a determined condition of correspondence between the first reference angular position and the second reference angular position, the condition of correspondence being equivalent to a synchronized configuration of the hook plate with respect to the needle cylinder, and wherein the processing means are configured and predisposed to control the synchronizing of the hook plate with respect to the needle cylinder, when the engaging mechanism is in the engaged configuration and the motion generated by the rotation means of the cylinder is transmitted to the hook plate.

In an aspect, the processing means are configured so as to halt the knitting machine when the engaging mechanism is in the engaged configuration and the correspondence condition is not verified.

In an aspect the correspondence condition includes an angular lag, between the first reference angular position and the second reference angular position, that is nil or is a determined value.

In an aspect the first reference angular position is one only for the whole rotation of the needle cylinder. In an aspect the second reference angular position is one only for the whole rotation of the hook plate.

In an aspect the first sensor and the second sensor are proximity sensors.

In an aspect the needle-bearing organ can be, equivalently, a needle plate. In an aspect the knitting machine is a circular knitting machine for knitwear, seamless knitwear, hosiery or the like.

Each of the above aspects of the invention can be taken alone or in combination with any one of the claims or the other aspects described.

Further characteristics and advantages will more fully emerge from the detailed description that follows of some embodiments, among which also a preferred embodiment, by way of non-exclusive example, of a circular knitting machine according to the present invention. The description will be set out in the following with reference to the appended drawings, provided by way of non-limiting example, in which.

Figure 1:
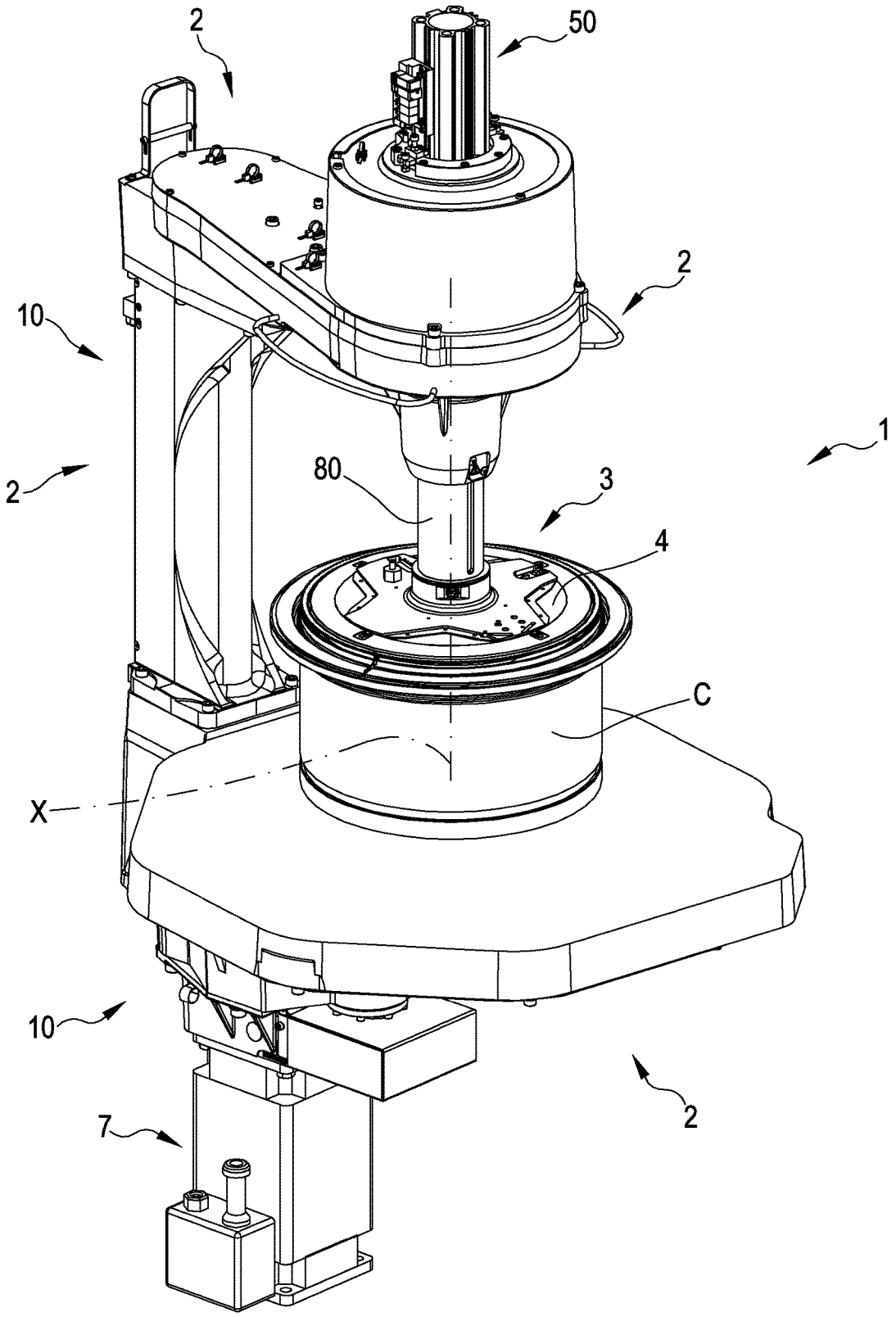
FIG. 1 is a perspective view of a possible embodiment of a circular knitting machine according to the present invention, with some parts removed; in particular the bearing structure, the needle cylinder, the dial group and the rotation transmission means are shown.
Figure 2:
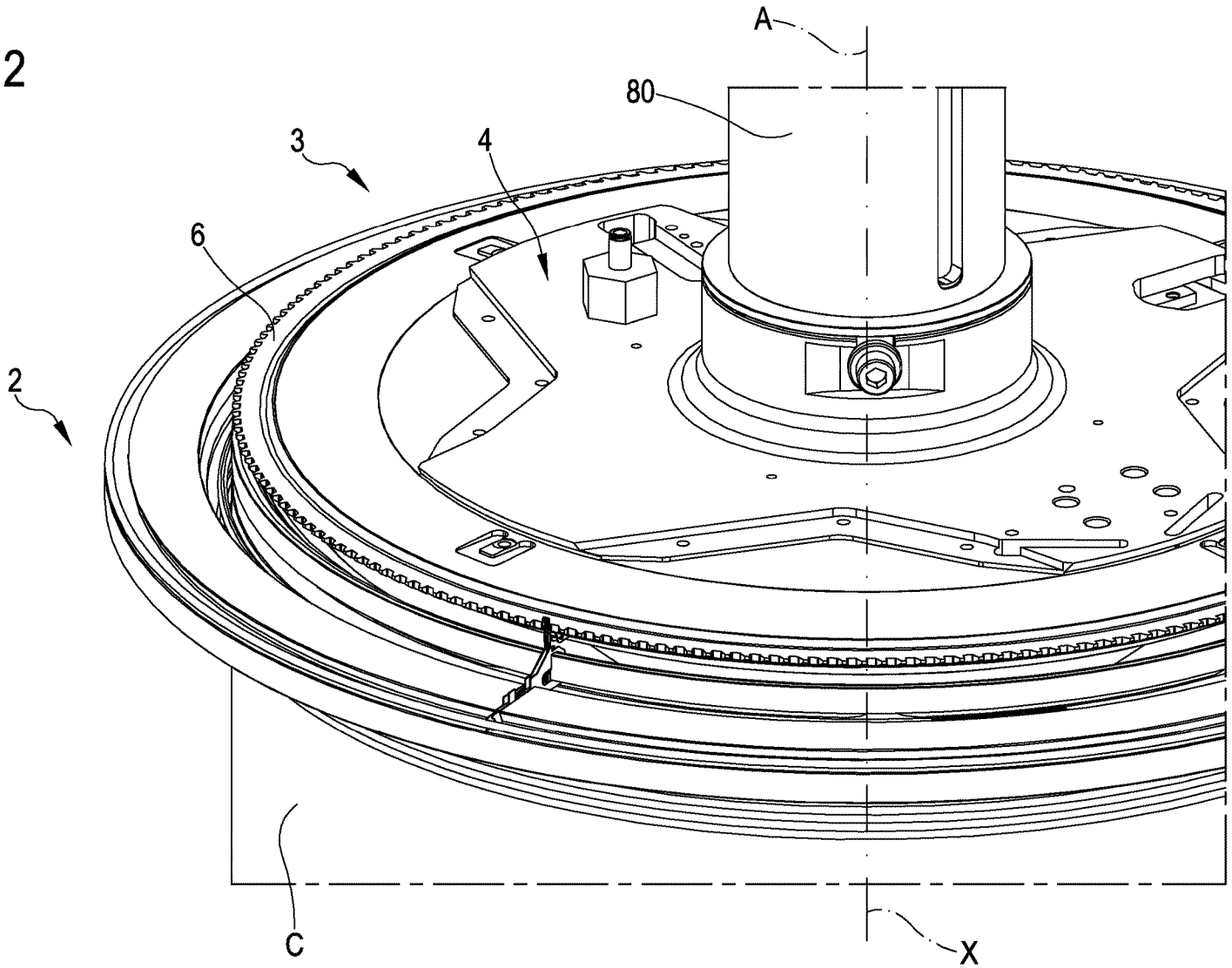
FIG. 2 is a larger-scale view of a portion of the knitting machine of FIG. 1, showing in detail the needle cylinder and the plate of the dial group.
Figure 3:
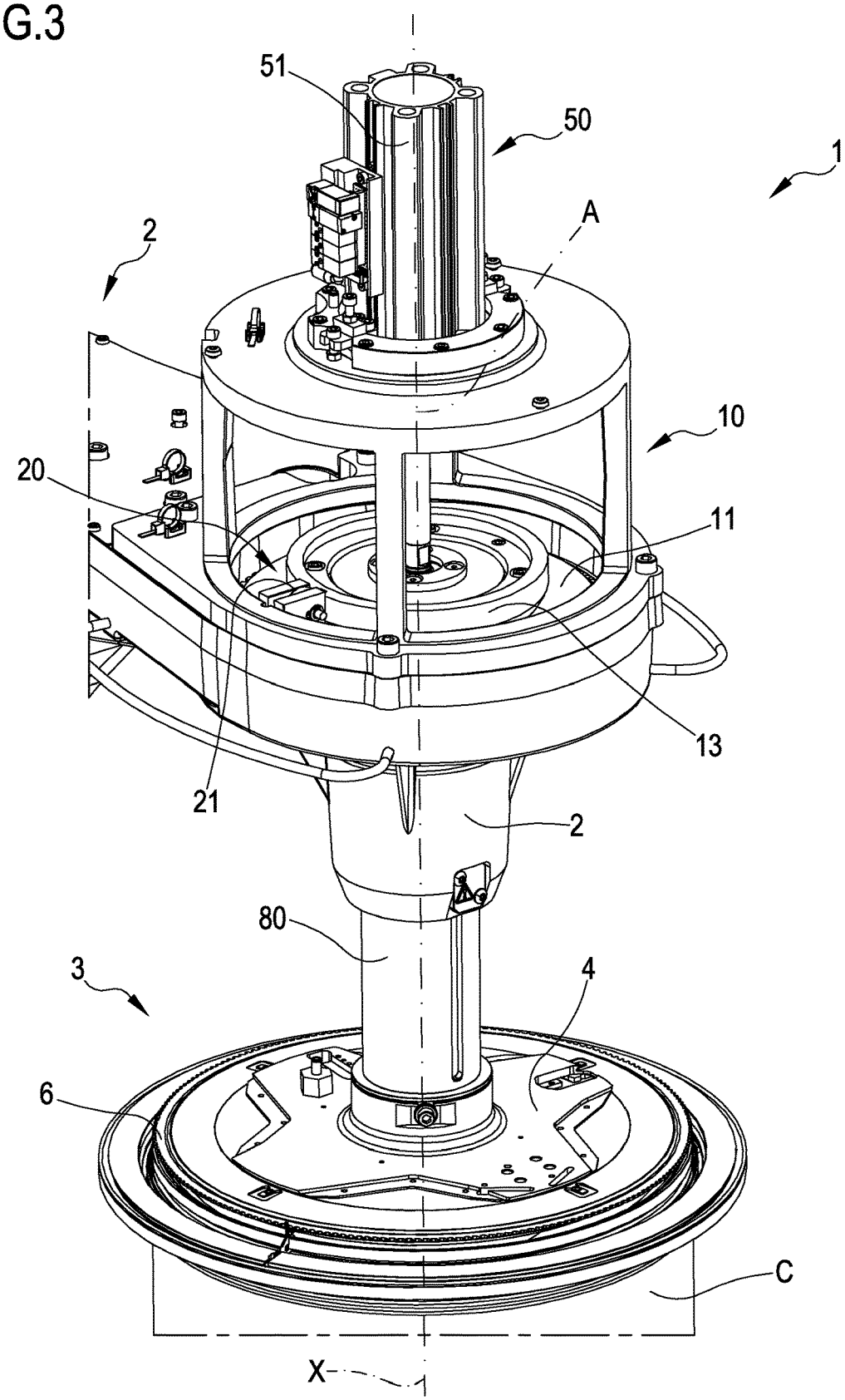
FIG. 3 is a further larger-scale view of the knitting machine of FIG. 1, showing in particular the dial group, with some parts removed, and part of the rotation transmission means.
Figure 4:
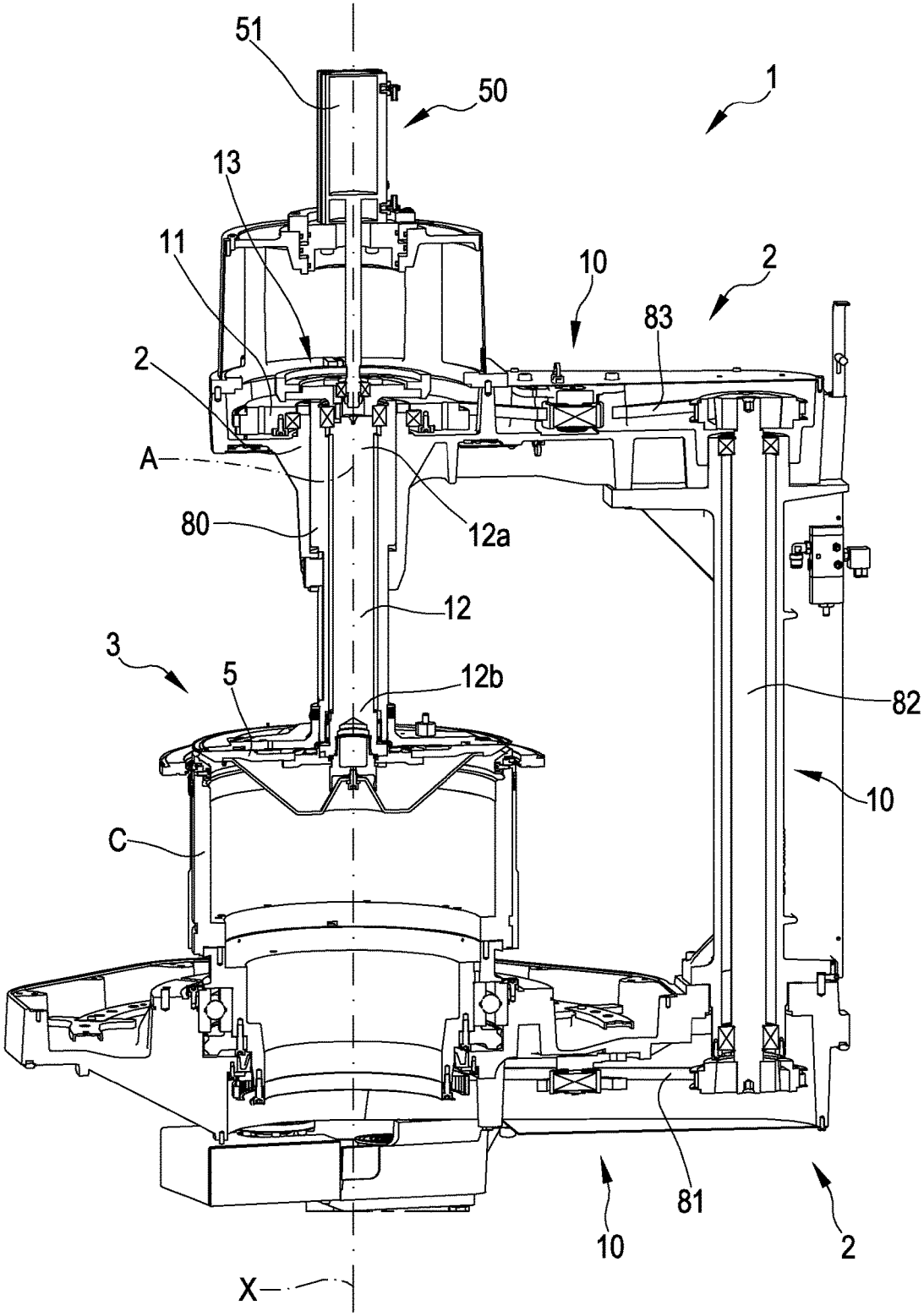
FIG. 4 is a perspective view in section, along a vertical plane passing through the rotation axis of the needle cylinder, of the knitting machine of FIG. 1.
Figure 5:
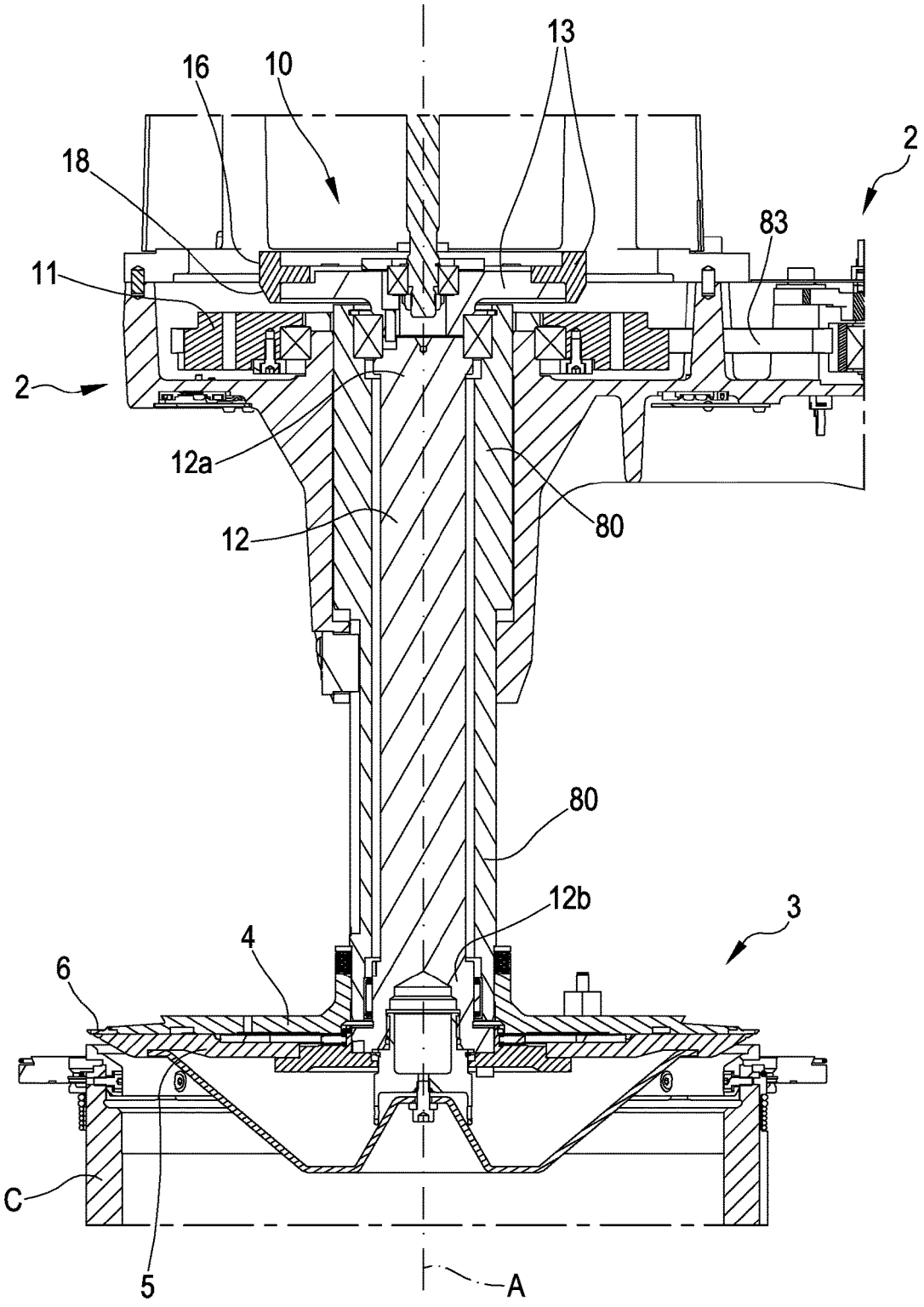
FIG. 5 is a further section view, along a vertical plane passing through the rotation axis of the needle cylinder, the knitting machine of FIG. 1, in particular the dial group and part of the rotation transmission means.
Figure 6:
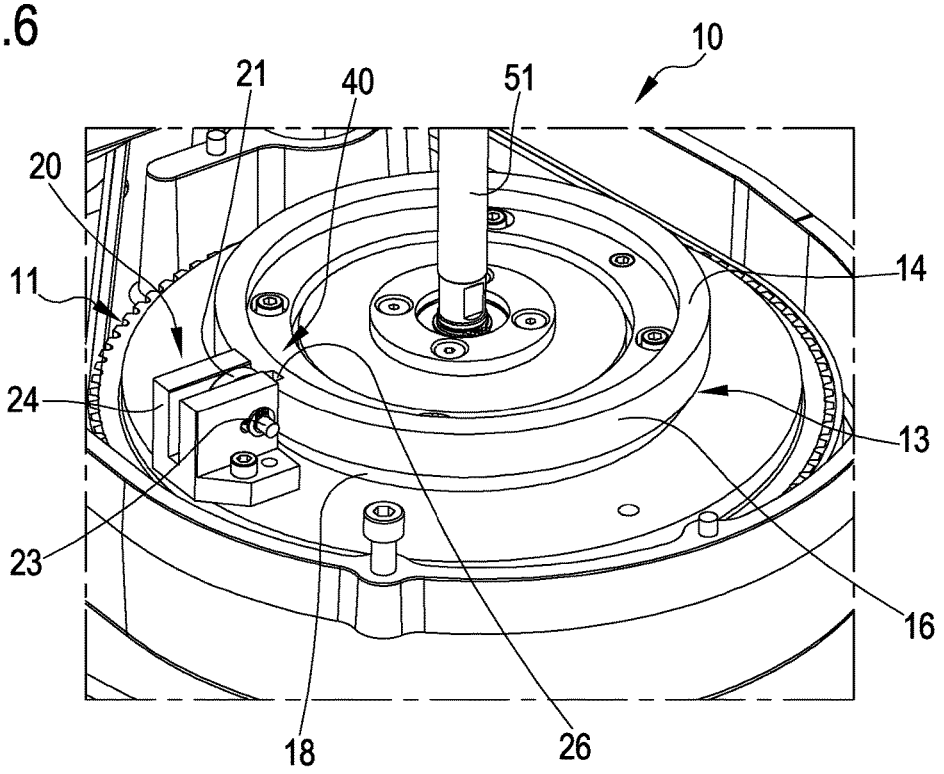
FIG. 6 is a partial perspective view of the machine of FIG. 1, with some parts removed, showing in particular the rotation transmission means and an engaging mechanism according to the present invention.
Figure 7:
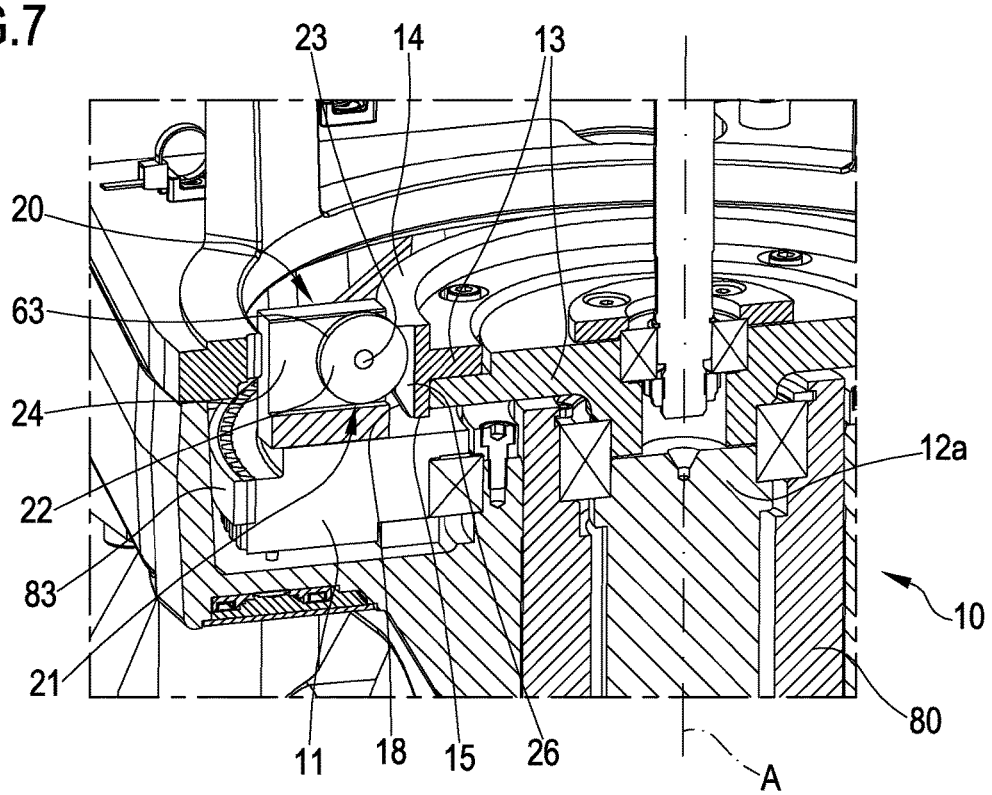
FIG. 7 is a perspective view in section, along a vertical plane passing through the rotation axis of the needle cylinder, of the portion of knitting machine of FIG. 6.
Figure 8:
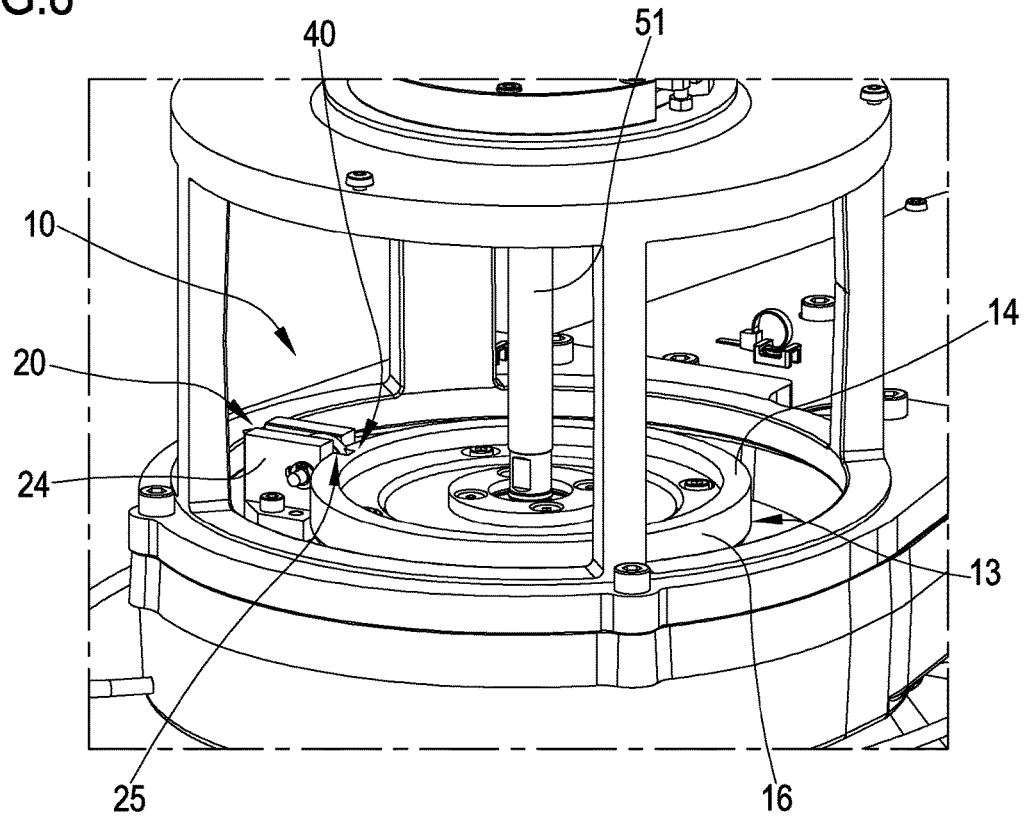
FIG. 8 is a further partial perspective view of the machine of FIG. 1, with some parts removed, showing in particular the rotation transmission means and an engaging mechanism according to the present invention.

With reference to the figures, reference numeral 1 denotes in its entirety a circular knitting machine according to the present invention. In general, the same reference number is used for the same or similar elements, possibly in the variant embodiments thereof.

FIG. 1 shows a possible embodiment of a knitting machine according to the present invention, with some parts removed. In particular, the illustration of the machine is focalized on the bearing structure, on the needle cylinder, on the dial group and on the rotation translation means, so as to enable comprehension of the present invention.

The basement of the knitting machine, the section comprising the processing board, further components of the knitting head and the needle-bearing organ, the needles themselves and other parts of the knitting machine are not shown in detail in the figures, as of known type and conventional. From the point of view of knitting technology, the functioning of the entire knitting machine (for example the functioning of the knitting head, the cooperation between needles and threads etc.) is not described in detail, being known in the technical sector of the present invention.

The knitting machine 1 comprises a bearing structure 2 and a needle cylinder C rotatably mounted to the bearing structure and rotatable selectively, by means of rotation means of the cylinder 7, about a rotation axis X of the needle cylinder. The rotation means of the cylinder 7 comprise, for example, an electric motor and an appropriate transmission (for example belt- or gear-driven) able to transmit the motion from the motor to the cylinder. The machine 1 further comprises a plurality of needles supported by the needle cylinder and mobile parallel to the rotation axis X so as to produce a knitted fabric.

The needle cylinder can have a variable diameter according to knitting requirements; for example the diameter can be 4 inches, 8 inches, 16 inches, 24 inches. The needle cylinder can equivalently be a needle plate.

The machine 1 further comprises a dial group 3, arranged superiorly of the needle cylinder C and comprising:

- a support plate 4 (or ring) solidly constrained to the bearing structure 2 and coaxial to the needle cylinder;
- a hook support organ, or hook plate 5, bearing a plurality of hooks and rotatably mounted on the support plate 4 in such a way as to be able to rotate about a respective rotation axis coinciding with the rotation axis X of the needle cylinder;
- a plurality of devices of the dial group, arranged on the support plate;
- a thread transport and cutting organ, or cutter 6, mounted externally of the support plate 4 and solidly constrained to the hook plate 5, in such a way as to rotate together with the plate 5.

The above plurality of devices comprises, for example, one or more hook command groups, a plurality of pliers groups, a plurality of cutters, a plurality of thread aspirating mouths, and possibly further auxiliary organs. The devices are not shown in the figures, as they can be of known type.

The above-mentioned hooks, as known in the sector of knitting machines, are mobile organs, independently of one another, perpendicularly to the rotation axis of the needle cylinder and along a radial direction, in order to cooperate with the plurality of needles so as to produce a knitted fabric.

The knitting machine 1 further comprises rotation transmission means 10, housed in the bearing structure 2 and interposed between the needle cylinder C and the dial group 3: the means 10 are configured for transmitting a rotation, generated by the rotation means of the cylinder 7, synchronously with the hook plate, in such a way that a determined rotation of the hook plate corresponds to a same rotation of the needle cylinder.

The rotation transmission means comprise:

- a drive pulley 11 receiving a rotary motion from the rotation means of the cylinder 7 and rotating, synchronously with respect to the needle cylinder C about a first rotation axis A;
- a hook plate shaft 12, coaxially mounted to the hook plate 5 and able to transmit a rotation to the hook plate;
- a flange 13, configured for transmitting a rotary motion to the shaft 12 of the hook plate, interposed between the pulley 11 and the hook plate shaft 12 and positioned at the pulley, the flange being able to rotate about the first rotation axis A.

As in the embodiment shown by way of example in the figures, the rotation transmission means 10 preferably further comprise:

- a lower belt 81, rotated by the rotation means of the cylinder;
- a relay shaft 82, located laterally of the needle cylinder and inferiorly connected to the lower belt;
- an upper belt 83, rotated by the relay shaft and configured for transmitting the rotary motion from the relay shaft to the pulley.

In practice, with appropriate pulleys, the lower belt connects the motor moving the needle cylinder with the relay shaft, while the upper belt connects the relay shaft with the pulley: the pulley then transfers the motion received to the flange (and from the flange to the hook plate) by interposing the engaging mechanism.

Note that the two belts (upper and lower) and the relay shaft in a lateral position enable carrying the rotation (produced by the rotation means of the cylinder) into the upper part of the machine, and from there to the dial group, overcoming the central object represented by the needle cylinder.

This configuration of the rotation transmission means enables, in substance, arranging a pulley set in rotation constantly synchronously with the needle cylinder. On the contrary, the flange is always in connection with the shaft of the hook plate, and thus the rotation of the flange determines the rotary motion of the hook plate.

With the purpose of selectively commanding the transfer of the drive between the pulley and the flange, the rotation transmission means comprise an engaging mechanism 20 interposed between the pulley 11 and the flange 13 and configured for operating selectively at least between an engaged position, in which it constrains the pulley and the flange to one another, determining a synchronous transmission of the rotary drive of the pulley to the flange and from the flange to the hook plate shaft, and a disengaged configuration, in which the flange 13 is free from constraints with respect to the pulley and the rotary motion of the pulley is not transmitted to the flange.

The engaging mechanism 20 comprises at least an engaging organ 21 movable between the pulley and the flange, in a parallel direction to, or transversally or perpendicularly intersecting, the first rotation axis A of the pulley and the flange, between at least an engaged position and a disengaged position so as to determine passage of the engaged mechanism 20 respectively between the engaged position and the disengaged position.

The engaging mechanism 20 further comprises actuating means 30, operatively active on the engaging organ 21 and configured for:

- enabling the passage of the engaging mechanism from the engaged configuration to the disengaged configuration in any angular position assumed by the flange or the pulley; and
- determining the passage of the engaging mechanism from the disengaged configuration to the engaged configuration exclusively with the engaging organ 21 positioned at a predetermined and limited number of angular engaging and disengaging positions 40 defined on the flange or the pulley.

On the flange 13 or the pulley 11, a number of angular engaging and disengaging positions 40 are preferably defined which are fewer than four or four and/or fewer than two or two and preferably (as in the embodiment of the figures) one and one only angular engaging and disengaging position 40 is defined.

In a preferred embodiment, the engaging organ 21 is preferably movable, between the pulley 11 and the flange 13, in a substantially radial direction with respect to the first rotation axis A, i.e. substantially perpendicular to, and intersecting the, first rotation axis A of the pulley and the flange. The engaging organ 21 is preferably movable on a substantially horizontal plane.

The first rotation axis A (of the pulley and the flange) preferably coincides with the rotation axis X of the needle cylinder C (and the hook plate); in this configuration (shown in the figures) the pulley and the flange are coaxial to one another and with the shaft of the hook plate, and are vertically aligned with the needle cylinder. This means that the needle cylinder, pulley, flange and hook plate can all rotate about the same rotation axis (A, X).

The shaft 12 of the hook plate 5 preferably extends from an upper end 12*a* to a lower end 12*b*, the hook plate is preferably mounted at the lower end 12*b* of the shaft 12 of the hook plate shaft.

The flange 13 is however preferably mounted coaxially to the upper end 12*a* of the hook plate shaft. In a variant embodiment, the flange and the shaft of the hook plate can be made in a single piece, and in this case the flange emerges radially from the upper end of the hook plate shaft.

The knitting machine 1 preferably comprises raising means 50 of the dial group 3, configured for vertically translating the whole dial group with respect to the needle cylinder along the rotation axis of the needle-bearing organ. In this way, the hook plate can be positioned at least between a lower (or lowered) position, in which it is neared to the needle-bearing organ, and an upper (or raised) position, in which it is vertically distanced from the needle-bearing organ (with respect to the lower position). The raising means 50 preferably comprise an actuator 51 active on the flange 13 and on the shaft of the hook plate. The vertical movement introduced by the raising means solidly involves the flange, the hook plate shaft and the hook plate.

A passage of the hook plate 5, by the raising means 50 of the dial group 3, from the lower position to the upper position, preferably automatically determines, irrespective of the angular position of the pulley-flange coupling, the passage of the engaging mechanism 20 into the disengaged configuration, deconstraining the flange with respect to the pulley, determining the halting of the hook plate and maintaining the pulley in rotation.

In substance, whatever the angular position of the pulley and the flange, which rotate solidly when the engaging mechanism is in the engaged configuration, the raising of the hook plate causes the passage of the mechanism 20 into the disengaged configuration. It is therefore not necessary for the pulley-flange assembly, reciprocally engaged, to reach a determined disengaging angular position: the raising of the hook plate, allowed at any moment, automatically causes the disengagement of the flange with respect to the pulley, and therefore the halting of the hook plate (and the cutter solidly constrained thereto).

A passage of the hook plate 5 by the raising means of the dial group from the upper position to the lower position and a relative rotation, without transmission of drive, between the pulley and the flange up to reaching, by the engaging organ, of the angular engaging and disengaging position 40, preferably determine an automatic passage of the engaging mechanism into the engaged position, constraining the flange with respect to the pulley and determining the synchronous rotation of the hook plate with respect to the needle cylinder.

The relative rotation between the pulley and the flange, without transmission of drive, during the passage of the engaging mechanism from the disengaged position to the engaged position, preferably has an angular dimension defining a resynchronising angle, the resynchronising angle being strictly smaller than 360°. The resynchronising angle is equal to the angle corresponding to the relative rotation between pulley and flange in order for the engaging organ 21 to reposition at the angular engaging and disengaging position 40.

The engaging mechanism 20 preferably comprises the engaging organ 21, positioned on the pulley or flange, and at least an engaging/disengaging seating 25 defining the angular engaging and disengaging position 40 and positioned, respectively, on the flange or on the pulley. The engaging/disengaging seating 25 is configured for stably housing the engaging organ 21 when it is in the engaged position, enabling a synchronous transmission of the drive between the pulley and the flange, and consequently between the needle cylinder and the hook plate.

The engaging organ 21 preferably comprises a wheel 22 rotatably mounted on a pin 23, the wheel being free to rotate about the pin and preferably being orientated on a plane comprising the first rotation axis A of the pulley and the flange. The pin 23 is preferably perpendicular to the wheel and is able to translate in a radial direction with respect to the first rotation axis A, such as to near or distance the wheel with respect to the first rotation axis.

The translation of the pin 23 preferably determines the positioning of the wheel 22 at least between an advanced position, in which the wheel is radially neared to the first rotation axis A and the engaging organ is brought into the engaged position, and a retracted position, in which the wheel is radially distanced from the first rotation axis A and the engaging organ 21 is in the disengaged position.

Figure 9:
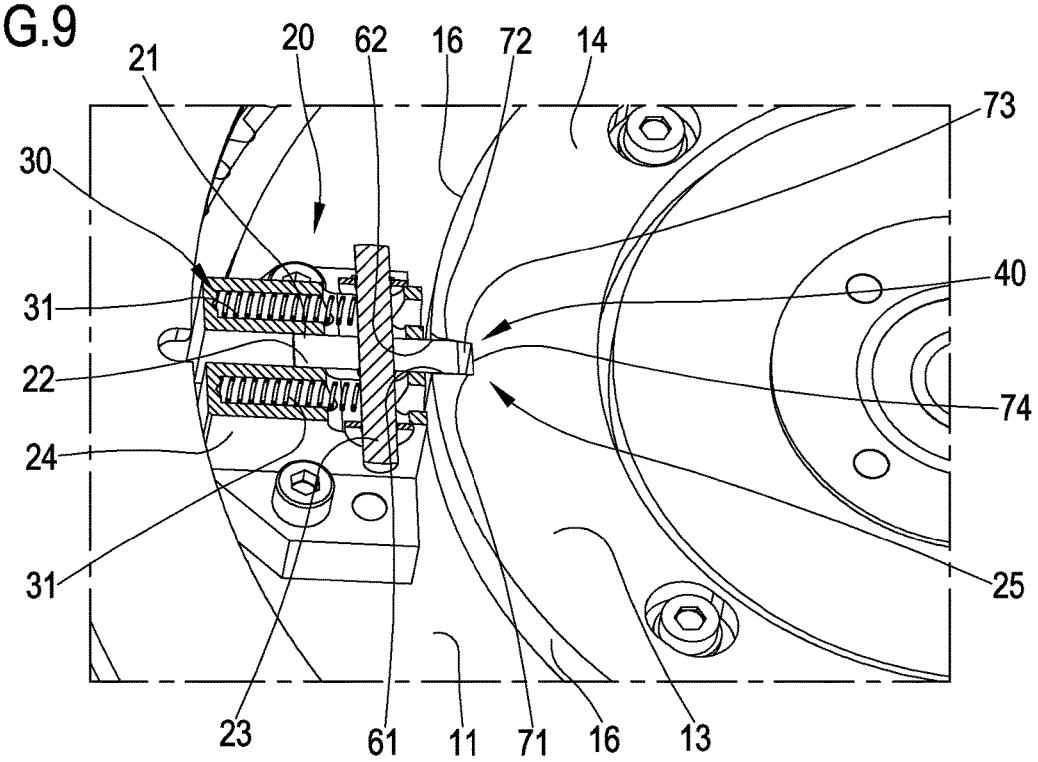
FIG. 9 is a partial perspective view of the machine of FIG. 1, with some parts removed, showing in particular an engaging mechanism according to the present invention sectioned along a horizontal plane.

The actuating means 30 preferably comprise at least an elastic organ 31 active on the pin (and/or directly on the wheel) so as to exert thereon a thrust facing, in a radial direction, towards the first rotation axis; the thrust maintains the wheel 22 in an advanced position or pushes the wheel towards the advanced position. As shown by way of example in FIG. 9, the actuating means preferably comprise a pair of elastic organs 31 active on the pin at two opposite sides of the pin with respect to the wheel 22. The elastic organ is preferably a spring or a helix spring 31.

In a preferred embodiment, the engaging organ 21 is positioned on the pulley and the engaging/disengaging seating 25 is preferably positioned on the flange 13. Further, preferably, the whole engaging organ 21 is positioned externally of the flange, i.e. it is positioned at a radial distance from the first rotation axis A greater than the respective radial distance of the engaging/disengaging seating 25 from the first rotation axis.

The engaging organ 21 is preferably positioned in such a way as to be at, and radially aligned with, the engaging/disengaging seating 25 when it reaches, by effect of the rotation of the pulley, the angular engaging and disengaging position 40.

The engaging/disengaging seating 25 is preferably configured so as to enable automatic entry, via the actuating means 30, of the engaging organ 21 internally thereof, when the hook plate 5 is brought, by the raising means 50, into the lower position and the pulley has made a rotation equal to the resynchronizing angle.

The flange 13 preferably exhibits an upper surface 14, a lower surface 15 and a lateral surface 16. The lateral surface 16 preferably has an annular shape and extends between, and connects, the upper surface and the lower surface. The engaging/disengaging seating 25 is preferably a radial recess 26 starting from the lateral surface 16 and externally open.

The recess 26 (realizing the engaging/disengaging seating) is preferably also open at least at a portion of lower surface of the flange, so that—on the raising of the hook plate—the engaging organ is free to exit from the engaging/disengaging seating 25 and the engaging mechanism passes into the disengaged position.

The upper surface 14 and the lower surface 15 are preferably orientated horizontally and at least an axial portion of the lateral surface (i.e. at least a portion of the thickness of the lateral surface) between the upper and lower surfaces and over the whole angular development of the flange, it is inclined transversally with respect to the upper and lower surfaces, so as to realize an annular thrust surface 18, not vertical, nearing the first rotation axis of the flange gradually as the lateral surface nears the lower surface.

The annular thrust surface 18 is preferably configured to press on the engaging organ 21, i.e. on the wheel 22, when the hook plate 5 is brought by the raising means 50 in the lower position, so as to radially displace the engaging organ—when the engaging organ is dealigned from the angular engaging and disengaging position or positions—from the engaging position, radially neared to the first rotation axis, to the disengaged position, compressing the elastic organ (or elastic organs), so that the engaging organ, is positioned abuttingly externally on the lateral surface of the flange and the rotation of the pulley with respect to the flange determines a sliding of the engaging organ on the lateral surface of the flange without there occurring a transmission of drive from the pulley to the flange, and such that following a successive rotation of the pulley equal to the resynchronizing angle, the engaging organ reaches the engaging and disengaging seating and inserts therein radially by effect of the thrust exerted towards the first rotation axis by the elastic organ.

In detail, with reference to the embodiment shown by way of example in the figures, the descent of the flange causes a retraction (towards the outside) of the wheel, caused by the annular thrust surface which presses on the wheel and compresses the springs, causing retraction of the pin on which the wheel is mounted; successively, the wheel remains pressed, by means of the thrust on the springs, against the lateral surface of the flange, and in this condition it drags on the lateral surface due to the rotation of the pulley. When the rotation of the pulley brings the wheel into the angular engaging and disengaging position (i.e. when the pulley has rotated by the above-cited resynchronising angle), the wheel abuts the engaging/disengaging seating and enters it, here too by effect of the thrust of the springs. The entry brings the mechanism 20 into the engaged configuration: from there on the pulley and the flange are solidly constrained to one another, and the rotation of the pulley is transferred synchronously to the flange, and from there to the hook plate.

In a variant embodiment, not shown, the actuating means can comprise, in replacement or additionally to the elastic organ, an actuator (for example a piston or a linear motor) active on the engaging organ and a sensor. In this case the sensor is active during the rotation of the pulley with the engaging organ in the disengaged position on the flange and is configured for detecting the presence of the engaging/disengaging seating: on reaching the seating, the sensor commands the activation of the actuator, which determines the entry of the engaging organ in the seating and the passage into the engaged position.

The thrust surface 18 is preferably realised by a bevelling between the lateral surface 16 and the lower surface 15 of the flange 13. The thrust surface 18 is preferably defined as an inclined plane with respect to the vertical movement direction of the dial group between the lower position and the upper position.

The engaging mechanism 20 preferably comprises a body 24 movably housing the engaging organ 21, in particular the pin 23 and/or the wheel 22, and the actuating means 30, in particular the elastic organ 31 (or the two springs 31 in the embodiment shown in the figures).

The body 24 of the engaging mechanism 20 is preferably mounted solidly on the pulley and is therefore set in rotation by the pulley.

The body 24 is preferably mounted on the pulley so as to be positioned externally with respect to the flange (on which the engaging/disengaging seating is present), in order to enable a radial movement of the engaging organ between the engaging and disengaging positions.

The flange 13 preferably has a height, calculated as the axial distance between the upper surface 14 and the lower surface 15, greater than 5 mm and/or greater than 10 mm and/or greater than 20 mm and/or greater than 40 mm and/or greater than 60 mm. The height defines a height for raising the hook plate 5 at which the engaging mechanism is brought into the disengaging configuration and the motion of the needle cylinder is not transmitted to the hook plate.

The raising means 50 of the dial group are preferably configured so as to position the hook plate in one or more intermediate positions, in each of which the hook plate is positioned at a respective intermediate vertical height between the height corresponding to the lower position and the height corresponding to the upper position. In each of the intermediate positions the engaging mechanism is in the engaged configuration and the hook plate is vertically partially distanced from the needle-bearing organ.

The raising means of the dial group are preferably configured for vertically raising the hook plate even beyond the upper position; this happens following the disengagement of the hook plate and enables freeing up a greater space between the dial group and the needle cylinder useful for maintenance operations. In substance, the dial group proceeds with the vertical raising following the disengagement; in the further raising there are no contacts or interactions between the engaging organ (located on the pulley) and the overlying flange. In this case, a successive lowering of the dial group includes a first descent towards the upper position, at which the contact is re-established between the engaging organ and flange and starts the passage towards the engaged configuration (and towards the lower position of the dial group).

The above-cited wheel 22 preferably has a cylindrical conformation and comprises a first flat lateral face 61, a second flat lateral face 62 and an annular surface 63 interposed between, and connecting, the lateral faces 61 and 62. The wheel 22 is preferably made of a metal material, for example iron or steel.

The engaging/disengaging seating 25, realised as a vertical recess 26 in the lateral surface 16 of the flange, preferably extends angularly between a first wall 71 and a second wall 72, between which an empty space 73 is present, destined to house the engaging organ 21 when it is brought into the engaging position, the seating 25 terminating internally of the flange with a bottom surface 74.

The first wall 71 preferably lies on a plane that is parallel to the first rotation axis A and orientated substantially radially with respect to the first rotation axis A; the first wall 71 is configured for entering into contact with a portion of the first lateral face 61 of the wheel when the wheel enters the seating and is brought into the engaged position.

The first wall 71 is preferably configured for receiving from the wheel 22, in particular from the first lateral face 61 of the wheel when the wheel is in the engaged position, a thrust determined by the rotation of the pulley, the thrust being transmitted to the first wall 71 of the seating and determining a synchronous and solidly constrained rotation of the flange with the pulley.

The position of the first wall 71 in the flange is preferably more advanced than the position of the second wall 72 with respect to the rotation direction of the pulley and the flange.

The second wall 72 preferably lies on a parallel plane to the first rotation axis A and inclined with respect to the plane on which the first wall lies, so that the distance between the first and the second wall, i.e. the width of the empty space between the first wall and the second wall, increases from the bottom surface 74 of the seating up to the lateral surface of the flange, at which the engaging/disengaging seating is open towards outside.

The second wall 72 is preferably configured for entering into contact with a corner portion formed by the second lateral face 62 of the wheel 22 with the external annular surface 63 of the wheel, when the wheel enters into the seating and is brought into the engaged position.

The second wall 72 is preferably inclined with respect to the first wall by an angle of greater than 1° and/or greater than 3° and/or greater than 5°.

The width of the empty space between the first 71 and the second wall 72 of the seating 25 preferably increases linearly, starting from the bottom surface 74 towards the outside, according to the inclination of the second wall with respect to the first.

The engaging/disengaging seating 25 provided with the second inclined wall 72 advantageously enables recuperating any play on entry of the wheel; in fact, the wheel enters the seating up to when the internal width of the seating corresponds to the width of the wheel. This guarantees the correct synchronising between the pulley and flange when the mechanism 20 is in the engaging configuration. On the contrary, the first wall 71 is advantageously flat since the first lateral face of the wheel abuts on the wall, which first lateral face constitutes the thrust face with which the wheel transmits the motion of the pulley to the seating, and from the seating to the whole flange.

When the hook plate 5 is in the lower position and the engaging mechanism is in the disengaged position, the rotation of the pulley 11 with respect to the flange 13 so as to follow the resynchronising angle, with the aim of bringing the wheel 22 to the engaging/disengaging seating, preferably determines a translation of the wheel on the lateral surface 16 of the flange and in contact therewith; in this condition, the annular surface 63 of the wheel drags on the lateral surface of the flange and the wheel performs no rotation about the axis thereof.

The raising of the hook plate into the upper position preferably determines the automatic exit of the wheel from the engaging/disengaging seating, which exit occurs by a rotation of the wheel with respect to the seating, preferably with respect at least to the second wall of the seating, in a first rotation direction. The exiting of the wheel from the seating determines the passage of the engaging mechanism into the disengaging configuration.

The lowering of the hook plate into the lower position preferably determines the retraction of the wheel by effect of the thrust exerted by the annular thrust surface and the compression of the elastic organ, the retraction occurring contemporaneously with a rotation of the wheel on the annular thrust surface of the flange, according to a second rotation direction opposite the first rotation direction. The retraction predisposes the engaging mechanism for a successive passage, when the resynchronising has occurred between the pulley and the flange, into the engaged configuration.

In an embodiment equivalent to the one shown in the figures, the seating can have the first wall and the second wall both not inclined and lying on a respective plane parallel to the first rotation axis A and orientated substantially radially with respect to the first rotation axis. In this case the wheel preferably has the second lateral face thereof lying on a parallel plane to the first rotation axis A and inclined with respect to the plane on which the first lateral face lies, so that the distance between the first and the second lateral face increases from externally of the wheel towards the pin. In this case the corner formed by the second wall of the seating with the external surface of the flange enters into contact with a portion of the second lateral face of the wheel, when the wheel enters the seating and is brought into the engaged position.

The above-mentioned corner formed by the second wall of the seating with the external surface of the flange preferably can be bevelled or shaped so as to facilitate the entry of the wheel into the seating, enabling a partial entry of the wheel into the seating when the first lateral face of the wheel has gone beyond the second wall of the seating but has not yet reached the first wall of the seating (on which it abuts so as to transfer the rotary motion from the pulley to the flange).

In substance the solution with the lateral faces of the wheel not parallel to one another and walls of the seating parallel to one another can be considered a variant embodiment with respect to what is shown in the figures. In both cases the technical solution advantageously enables recuperating any play on entry of the wheel.

In an embodiment that is not illustrated the rotation transmission means comprise at least a braking organ operatively active on the hook plate and configured for exerting a braking force on the hook plate when the pulley rotates, without any drive transmission, with respect to the flange and the wheel translates laterally, draggingly, on the lateral surface of the flange. The braking organ preferably exerts the braking force following a lowering of the plate into the lower position, for at least a 360° rotation of the pulley or for at least a rotation of the pulley by an angle equal to the resynchronising angle, such as to enable the engaging organ to reach the engaging/disengaging seating.

The braking organ enables preventing, with the dial group in a lowered position and during the rotation of the pulley by the resynchronizing angle, the dragging of the wheel externally on the flange from causing an undesirable dragging of the hook plate. In fact, during the resynchronizing the flange must not rotate (up to when the engaging organ 21 reaches the seating 25): the braking organ is also configured to drag on the flange, so as to produce a friction thereof which keeps it stationary. In this way the friction of the braking organ compensates for the eventual thrust generated by the dragging of the wheel on the flange, guaranteeing that it is stationary during the resynchronising. The braking organ is an optional component.

The braking organ can be a piston, for example pneumatic, commanded by a solenoid valve.

The thrust organ is advantageously the above-mentioned wheel, but can also take on different conformations, for example with a pin, an inclined plane, etc.

The rotation means 7 of the needle cylinder are preferably configured so as to set the needle cylinder—and therefore the drive pulley—in rotation in a single rotation direction, the rotation preferably being continuous regardless of the configuration assumed by the engaging mechanism.

As shown by way of example in the figures, the bearing structure 2 preferably comprises a sleeve 80 arranged coaxially to the cylinder rotation axis X and provided with a through-opening crossed by and housing the above-mentioned shaft 12 of the hook plate. The sleeve is provided with a lower end to which the support plate 4 of the dial group is solidly mounted and from which the lower end of the shaft of the hook plate emerges inferiorly, to which lower end the hook plate is mounted. The sleeve structurally bears the support plate and the devices present thereon and enable the shaft of the hook plate to rotate and translate internally thereof, transmitting the rotation and vertical translation of the hook plate and the cutter. In substance the sleeve 80 connects the plate 4 of the dial group to the bearing structure 2 and at the same time decouples the hook plate 5 from the plate 4, as it enables the shaft 12—rotating internally thereof—to support and rotate the underlying hook plate. Further, the sleeve is moved vertically by the raising means 50, so that the whole dial group can be raised and lowered, but without this interfering with the rotation of the hook plate.

In a possible embodiment (not illustrated) of the present invention, the rotation transmission means comprise:

processing means;

- a first sensor positioned on the bearing structure and configured for detecting a first angular reference position relative to the needle cylinder, during the rotation of the needle cylinder, and for transmitting to the first processing means a first detecting datum of the first reference angular position;
- a second sensor positioned on the dial group and configured for detecting a second reference angular position relative to the hook plate, or directly correlated to the hook plate, during the rotation of the hook plate, and to transmit to the processing means a second detecting datum of the second reference angular position.

The processing means are configured for comparing the first detecting datum with the second detecting datum, with the aim of verifying a determined condition of correspondence between the first reference angular position and the second reference angular position. This condition of correspondence is equivalent to a "synchronised configuration" of the hook plate with respect to the needle cylinder. The processing means are configured for controlling the synchronizing of the hook plate with respect to the needle cylinder when the engaging mechanism is in the engaged configuration and the motion generated by the rotation means of the cylinder is transmitted to the hook plate.

The processing means are preferably configured so as to halt the knitting machine when the engaging mechanism is in the engaged configuration and the condition of correspondence is not satisfied.

The correspondence condition preferably includes an angular lag, between the first reference angular position and the second reference angular position, that is nil or is a determined value.

The first reference angular position is preferably one only for the whole rotation of the needle cylinder. The second reference angular position is preferably one only for the whole rotation of the hook plate.

The first sensor and the second sensor are preferably proximity sensors of a magnetic or optical or capacitive or inductive or ultrasound type. The first sensor and/or the second sensor are preferably fixed.

The first sensor is preferably configured for detecting the first angular reference position (relative to the needle cylinder), by detecting a determined position of the needle cylinder (for example a notch or pin on the cylinder or a determined reference needle) or the pulley.

The second sensor is preferably configured for detecting the second angular reference position (relative to the hook plate), by detecting a position of the hook plate or the shaft of the hook plate or the flange or the cutter. The second sensor is preferably mounted on the support plate of the dial group; alternatively it can be positioned on the bearing structure, as long as it is able to detect the position of the hook plate or a correlated position of the hook plate, for example a position of the shaft of the hook plate or the flange or the cutter.

The invention as it is conceived is susceptible to numerous modifications and variants, all falling within the scope of the inventive concept, and the cited components are replaceable with other technically equivalent elements.

The present invention is applicable on both new machines and already-existing machines, in the latter case for introducing an engaging mechanism according to the present invention, which enables selectively disengaging the rotation of the hook plate with respect to the rotation of the needle cylinder.

The invention offers considerable advantages. Primarily, the whole invention enables obviating at least some of the drawbacks in the prior art.

Further, the present invention relates to a circular knitting machine characterised by an engaging/disengaging mechanism of the hook plate (and therefore of the cutter) with respect to the needle cylinder, which is of a different type with respect to the prior art. The described mechanism is of the continuously-synchronised type: this means that it is not necessary to wait for a determined angular position of the pulley with respect to the flange in order to carry out the disengaging of the hook plate (by vertical raising), nor is it necessary to return the pulley into a determined angular position in order to newly set up the rotation of the hook plate. The solution of the present invention enables disengaging in any angular position and autonomously returns the pulley into the correct position in which to reconnect the pulley to the flange, so that the pulley and flange return to rotate solidly and the synchronism is guaranteed (i.e. the angular velocity) in the rotation of the needle cylinder and the hook plate.

Further, the mechanism of the present invention enables guaranteeing a correct synchronising of the hook plate with respect to the needle cylinder: by synchronising is meant a condition in which each point of the hook plate, when the hook plate rotates, is always vertically aligned with a respective corresponding point of the underlying needle cylinder.

The present description and the appended figures illustrate a preferred solution, in which the engaging organ is positioned on the pulley and the engaging/disengaging seating is located on the flange. However the invention includes an equivalent variant embodiment in which the position of the elements is inverted, i.e. the engaging organ is positioned on the flange and the engaging/disengaging seating is located on the pulley.

The solution described, which includes a radial and lateral movement of the engaging organ in the passage thereof between the engaged position and the disengaged position, enables obtaining important advantages.

Primarily, the lateral entry of the engaging organ in the seating enables maintaining the pulley/flange coupling, during the raising of the dial group by the raising means, up to a height equal to that of the flange, i.e. up to when the engaging organ exits inferiorly of the engaging/disengaging seating (in particular up to when the raising causes the exit of the engaging organ from the open recess on the lower surface of the flange). Further, the lateral entry of the engaging organ in the seating enables maintaining the pulley/flange coupling stable for each raised height, up to a raising that is equal to the height (or axial thickness) of the flange.

In fact, the wheel is laterally inserted in the recess that embodies the seating also during the raising of the flange, and this guarantees the coupling precision and the absence of bending or torsion stresses on the wheel. This is irrespective of the height of the lateral surface of the flange and therefore of the vertical height which it is necessary to reach in order to obtain the disengaging of the flange (and the halting of the transmission of the rotation from the pulley to the flange). Further, the present solution enables reducing the wear of the mechanical organs involved in the disengaging and the engaging, in particular of the wheel and the seating.

The radial motion of the engaging organ further enables realising a flange having a height (or width) that is selectable: the greater the height of the flange, the greater the vertical rise attained by the dial group at the moment of disengagement. By selecting the height of the flange it is therefore possible to set the vertical height at which the disengagement of the dial group occurs (and therefore of the hook plate and the cutter). In particular a significantly raised disengagement height can be obtained, with an advantage in terms of accessibility to the needle cylinder during the maintenance step: in fact, in the known solutions the disengagement of the hook plate happens at a low vertical height, as the disengaging means are not able to manage a large-entity rise.

On the contrary, the present invention describes engaging and disengaging means which do not suffer from the vertical distancing of the dial group from the underlying cylinder, and are able to operate in any condition with the same coupling precision and without being subjected to damaging stresses (for example bendings or torsions).

In fact, note that in any operating condition the engaging organ of the present invention, in particular in the wheel form thereof shown in the figures, efficiently enters the recess realising the seating, and is not working "projectingly" gradually as the dial group is being raised: on the contrary, it always maintains the same type of mechanical coupling, in particular between the lateral faces of the wheel and the walls of the engaging/disengaging seating, and produces a constant transmission of the rotary motion from the pulley to the flange. The greater vertical height reachable by the dial group at the moment of the disengagement constitutes a significant advantage in the sector, as it enables increasing the accessibility to the knitting head during maintenance.

The present invention enables obtaining a disengagement height that is selectable and at least 10 mm and/or at least 30 mm and/or at least 60 mm and/or at least 100 mm. The present solution further enables defining a plurality of vertical positions, in a controlled way, that the dial group can assume. For example, the actuator 51 of the raising means 50 can be a linear motor (or an electric rotary motor with a linear transmission of the motion) able to position the dial group at various intermediate heights between the lower position and the upper position (in which the disengaging occurs). This can be useful in certain knitting operations, in which slightly lifting the dial group with respect to the needle cylinder is desirable.

A further advantage of the solution at the base of the present invention consists in disengaging and engaging the rotation of the hook plate (and the cutter while working, i.e. during the knitting operations). For example, during the knitting of a garment, the hook group can be raised and then—after a revolution thereof—lowered, with the knitting machine in rotation: in this way a lag of 360° of the hook plate is obtained with respect to the cylinder. The engaging mechanism of the present invention further enables, in the embodiment thereof including an active activation of the engaging organ (in place of the elastic organs), maintaining the dial group in a disengaged configuration for a desired number of rotations of the cylinder, then to proceed to automatic resynchronising and re-engaging.

The present invention enables simplifying the machine maintenance operations, and in general improving the accessibility to the dial group and the knitting head. Further, the present invention enables arranging the disengaging means of the hook plate (and the cutter) able to guarantee a correct, precise and repeatable synchronisation of the hook plate with respect to the needle cylinder. Further, the present invention enables having disengaging means of the hook plate (and the cutter) that are characterised by a high degree of reliability, resistance to wear and stress and long working life.

Further, the knitting machine of the present invention is characterised by a competitive cost and a simple and rational structure.

The invention claimed is:

1. A circular knitting machine (1) for knitwear or hosiery, comprising:

a bearing structure (2);

at least a needle-bearing organ or needle cylinder (C) rotatably mounted in the bearing structure and rotatable selectively, by rotation means of the cylinder (7), about a rotation axis (X) of the needle-bearing cylinder, wherein the rotation means of the cylinder comprise an electric motor and a transmission;

a plurality of needles supported by the needle cylinder and mobile parallel to a rotation axis (X) of the needle cylinder so as to produce a knitted fabric;

a dial group (3) arranged above the needle cylinder and comprising:

a support ring (4) solidly constrained to the bearing structure and coaxial to the needle cylinder;

a hook support organ, or hook plate (5), bearing a plurality of hooks, the hook plate being rotatably mounted to the support plate (4) in such a way as to rotate about a respective rotation axis coinciding with the rotation axis (X) of the needle cylinder;

a thread transport and cutting organ, or cutter (6), mounted externally of the support plate (4) and solidly constrained to the hook plate (5), in such a way as to rotate together with the plate; the knitting machine further comprising rotation transmission means (10), housed in the bearing structure and operatively interposed between the needle cylinder (C) and the dial group (3), configured for transmitting a rotation, generated by said rotation means of the cylinder, synchronously to the hook plate (5), such that a determined rotation of the hook plate corresponds to a same rotation of the needle cylinder, the rotation transmission means (10) comprising:

a drive pulley (11) receiving a rotary motion from the rotation means of the cylinder (7) and rotating, synchronously with respect to the needle cylinder (C), about a first rotation axis (A);

a hook plate shaft (12), coaxially mounted to the hook plate (5) and configured so as to transmit a rotation to the hook plate;

a flange (13), configured so as to transmit a rotary motion to the shaft (12) of the hook plate, operatively interposed between the pulley (11) and the hook shaft and positioned at the pulley, the flange (13) being able to rotate about the first rotation axis (A);

an engaging mechanism (20) operatively interposed between the pulley (11) and the flange (13) and configured for selectively operating at least between an engaged configuration, in which it constrains the pulley and the flange to one another, determining a synchronous transmission of the rotary drive of the pulley to the flange and from the flange to the hook plate shaft, and a disengaged configuration, in which the flange is free from constraints with respect to the pulley and the rotary motion of the pulley is not transmitted to the flange, wherein the engaging mechanism (20) comprises at least an engaging organ (21) movable, between the pulley (11) and the flange (13), in a direction which is parallel to, or transversally or perpendicularly intersecting, the first rotation axis (A) of the pulley and the flange, between at least an engaged position and a disengaged position so as to determine passage of the engaged mechanism (20) respectively between the engaged position and the disengaged position, and wherein the engaging mechanism (20) comprises actuating members (30) operatively active on the engaging organ (21) and configured for enabling the passage of the engaging mechanism (20) from the engaged configuration to the disengaged configuration in any angular position assumed by the flange (13) or the pulley (11), and for determining the passage of the engaging mechanism from the disengaged configuration to the engaged configuration exclusively with the engaging organ (21) positioned at a predetermined and limited number of angular engaging and disengaging positions (40) defined on the flange (13) or the pulley (11).

2. The circular knitting machine (1) of claim 1, wherein the engaging mechanism (20) comprises the engaging organ (21), positioned on the pulley (11) or on the flange (13), and at least an engaging/disengaging seating (25) defining the angular engaging and disengaging position (40) and positioned, respectively, on the flange (13) or on the pulley (11), the engaging/disengaging seating (25) being configured so as to stably house the engaging organ (21) when in the engaged position, enabling a synchronous transmission of the drive between the pulley (11) and the flange (13), and consequently between the needle cylinder (C) and the hook plate (5).

3. The circular knitting machine (1) of claim 1, wherein the pulley (11) rotates about a rotation axis coinciding with the rotation axis (X) of the needle cylinder, and wherein the shaft (12) of the hook plate extends from an upper end (12*a*) to a lower end (12*b*), the hook plate (5) being mounted at the lower end (12*b*) of the shaft (12) of the hook plate, and wherein the flange (13) is mounted coaxially to the upper end (12*a*) of the hook plate shaft, and wherein the first rotation axis (A) coincides with the rotation axis (X) of the needle cylinder (C) and the hook plate (5).

4. The circular knitting machine (1) of claim 1, comprising raising members (50) of the dial group (3), configured for vertically translating the whole dial group (3) with respect to the needle cylinder (C) along the rotation axis (X) of the needle cylinder, so as to position the hook plate (5) at least between a lower position, in which it is neared to the needle plate, and an upper position, in which it is vertically distanced from the needle cylinder with respect to the lower position, the raising members (50) comprising an actuator (51) active on the flange (13) and on the shaft (12) of the hook plate (5), and wherein a passage of the hook plate (5), by the raising members (50) of the dial group, from the lower position to the upper position, automatically determines the passage of the engaging mechanism (20) into the disengaged position, deconstraining the flange (13) with respect to the pulley (11), determining the halting of the hook plate (5) and maintaining the pulley (11) in rotation, and wherein a passage of the hook plate (5) by the raising members (50) of the dial group from the upper position to the lower position and a relative rotation, without transmission of drive, between the pulley (11) and the flange (13) up to reaching, by the engaging organ (21), of the angular engaging and disengaging position (40), determine an automatic passage of the engaging mechanism (20) into the engaged position, constraining the flange (13) with respect to the pulley (11) and determining the synchronous rotation of the hook plate (5) with respect to the needle cylinder (C), and wherein the relative rotation between the pulley (11) and the flange (13), without transmission of drive, during the passage of the engaging mechanism (20) from the disengaged position to the engaged position, has an angular dimension defining a resynchronising angle, the resynchronising angle being strictly smaller than 360°.

5. The circular knitting machine (1) according to claim 1, wherein the engaging organ (21) comprises a wheel (22) rotatably mounted on a pin (23), the wheel (22) being free to rotate about the pin (23) and being orientated on a plane comprising the first rotation axis (A) of the pulley and the flange, the pin (23) being perpendicular to the wheel and being able to translate in a radial direction with respect to the first rotation axis (A), such as to near or distance the wheel with respect to the first rotation axis (A), and wherein the translation of the pin (23) determines the positioning of the wheel (22) at least between an advanced position, in which the wheel is radially neared to the first rotation axis (A) and the engaging organ is brought into the engaged position, and a retracted position, in which the wheel (22) is radially distanced from the first rotation axis and the engaging organ (21) is in the disengaged position.

6. The circular knitting machine (1) of claim 1, wherein the engaging organ (21) is positioned on the pulley (11) and the engaging/disengaging seating (25) is positioned on the flange (13) and wherein the engaging organ (21) is positioned externally of the flange.

7. The circular knitting machine (1) of claim 4, wherein the flange (13) exhibits an upper surface (14), a lower surface (15) and a lateral surface (16) of annular shape, extending between, and connecting, the upper surface and the lower surface, the engaging/disengaging seating (25) being a radial recess (26) starting from the lateral surface (16) and externally open, and wherein the recess (26) realizing the engaging/disengaging seating (25) is open at least at a portion of the portion of the lower surface (15) of the flange, so that the raising of the hook plate (5) into the upper position determines the exit of the engaging organ (21) from the engaging/disengaging seating (25) and passage of the engaging mechanism (20) into the disengaged configuration.

8. The circular knitting machine (1) of claim 1, wherein the flange (13) has a height, calculated as the axial distance between the upper surface (14) and the lower surface (15), greater than 10 mm or greater than 20 mm and/or or greater than 40 mm or greater than 60 mm, the height defining a raising height of the hook plate (5) at which the engaging mechanism is brought into the disengaged configuration and the motion of the needle cylinder is not transmitted to the hook plate (5).

9. The circular knitting machine (1) of claim 1, wherein the wheel (22) has a cylindrical conformation and comprises a first (61) and a second lateral face (62) that is flat and an annular surface (63) interposed between, and connecting, the lateral faces, and wherein the engaging/disengaging seating (25), realized as a vertical recess (26) in the lateral surface (16) of the flange (13), extends angularly between a first wall (71) and a second wall (72), between which an empty space is present (73), destined to house the engaging organ (21) when it is brought into the engaged position, the seating (25) terminating internally of the flange with a bottom surface (74).

10. The circular knitting machine (1) of claim 1, wherein the rotation transmission means comprise:

a processing unit;

a first sensor positioned on the bearing structure and configured so as to detect a first angular reference position relative to the needle cylinder, during the rotation of the needle cylinder, and so as to transmit to the processing unit a first detecting datum of the first reference angular position;

a second sensor positioned on the dial group and configured to detect a second reference angular position relative to the hook plate, or directly correlated to the hook plate, during the rotation of the hook plate, and to transmit to the processing unit a second detecting datum of the second reference angular position;

wherein the processing unit is configured and predisposed to compare the first detecting datum with the second detecting datum, with the aim of verifying a determined condition of correspondence between the first reference angular position and the second reference angular position, the condition of correspondence being equivalent to a synchronized configuration of the hook plate with respect to the needle cylinder, and wherein the processing unit is configured and predisposed to control the synchronizing of the hook plate with respect to the needle cylinder when the engaging mechanism is in the engaged configuration and the motion generated by the rotation means of the cylinder is transmitted to the hook plate.

11. The circular knitting machine (1) of claim 1, wherein, on the flange (13) or the pulley (11), a number of angular engaging and disengaging positions (40) are defined which are fewer than four or four, or fewer than two or two, or wherein, on the flange or pulley, one and one only angular engaging and disengaging position (40) is defined.

12. The circular knitting machine (1) of claim 1, wherein the engaging organ (21) is mobile, between the pulley (11) and the flange (13), in a radial direction with respect to the first rotation axis (A).

13. The circular knitting machine (1) of claim 5, wherein the actuating members (30) comprise at least an elastic organ (31) active on the pin (23) and on the wheel (22) so as to exert thereon a thrust facing, in a radial direction, towards the first rotation axis (A), so as to maintain the wheel (22) in an advanced position or to push the wheel (22) towards the advanced position, and wherein the at least an elastic organ is a spring or a helix spring (31).

14. The circular knitting machine (1) of claim 1, wherein the engaging organ (21) is positioned in such a way as to be at and radially aligned with the engaging/disengaging seating (25) when it reaches, by effect of the rotation of the pulley (11), the angular engaging and disengaging position (40).

15. The circular knitting machine (1) of claim 4, wherein the engaging/disengaging seating (25) is configured so as to enable automatic entry, via the actuating members (30), of the engaging organ (21) internally thereof, when the hook plate (5) is brought, by the raising members (50), into the lower position and the pulley (11) has made a rotation equal to the resynchronizing angle.

16. The circular knitting machine (1) of claim 7, wherein the upper surface (14) and the lower surface (15) are orientated horizontally and at least an axial portion of the lateral surface (16), between the upper and lower surface and over the whole angular development of the flange (13), and inclined transversally with respect to the upper and lower surface, so as to realize an annular thrust surface (18) nearing the first rotation axis of the flange gradually as the lateral surface (16) nears the lower surface (15), and wherein the annular thrust surface (18) is configured to press on the engaging organ (21), in particular the wheel (22), when the hook plate (5) is brought by the raising members (50) into the lower position, so as to radially displace the engaging organ—when the engaging organ is dealigned from the angular engaging and disengaging position or positions—from the engaging position, radially neared to the first rotation axis, to the release position, compressing the at least an elastic organ (31), so that the engaging organ (21), in particular the wheel, is positioned abuttingly externally of the lateral surface (16) of the flange (13) and the rotation of the pulley (11) with respect to the flange determines a sliding of the engaging organ (21), preferably of the wheel (22), on the lateral surface of the flange without there occurring a transmission of drive from the pulley to the flange, and such that following a successive rotation of the pulley of the resynchronizing angle, the engaging organ reaches the engaging and disengaging seating (25) and inserts therein radially by effect of the thrust exerted towards the first rotation axis (A) by the at least an elastic organ (31).

17. The circular knitting machine (1) of claim 4, wherein the raising members (50) of the dial group (3) are configured for positioning the hook plate (5) in one or more intermediate positions, in each of which the hook plate positions at a respective intermediate vertical height between the height corresponding to the lower position and the height corresponding to the upper position, in which in each of the intermediate positions the engaging mechanism is in the engaged configuration and the hook plate is vertically partially distanced from the needle cylinder.

18. The circular knitting machine (1) of claim 9, wherein the first wall (71) lies on a plane which is parallel to the first rotation axis (A) and orientated radially with respect to the first rotation axis, the first wall being configured so as to enter into contact with a portion of the first lateral face (61) of the wheel (22) when the wheel enters in the seating and is brought into the engaged position, and wherein the first wall (71) is configured so as to receive from the wheel, in particular from the first lateral face (61) of the wheel, when the wheel is in the engaged position, a thrust determined by the rotation of the pulley (11), the thrust being transmitted to the first wall (71) of the seating (25) and determining a synchronous and solid rotation of the flange (13) with the pulley (11).

19. The circular knitting machine (1) of claim 9, wherein the second wall (72) lies on a plane which is parallel to the first rotation axis (A) and inclined with respect to the plane on which the first wall lies, so that the distance between the first (71) and the second wall (72), increases from the bottom surface (74) of the seating (25) up to the lateral surface (16) of the flange, at which the engaging/disengaging seating (25) is open towards outside, and wherein the second wall (72) is configured for entering into contact with a corner portion formed by the second lateral face (62) of the wheel with the external annular surface (63) of the wheel (22), when the wheel (22) enters into the seating (25) and is brought into the engaged position.

20. The circular knitting machine (1) of claim 10, wherein the processing unit is configured so as to halt the knitting machine when the engaging mechanism is in the engaged configuration and the correspondence condition is not verified, and wherein the correspondence condition includes an angular lag, between the first reference angular position and the second reference angular position, that is nil or is a determined value.

* * * * *